US007963775B2

(12) United States Patent
Reisinger et al.

(10) Patent No.: US 7,963,775 B2
(45) Date of Patent: Jun. 21, 2011

(54) ELECTRICAL CONNECTOR HAVING AT LEAST ONE HOLE WITH SURFACE MOUNT PROJECTIONS

(75) Inventors: Jason M'Cheyne Reisinger, Carlisle, PA (US); Justin Shane McClellan, Camp Hill, PA (US); Nathan William Swanger, Mechanicsburg, PA (US); Jeffrey Byron McClinton, Harrisburg, PA (US); Richard Elof Hamner, Hummelstown, PA (US); Peter Paul Wilson, Palmyra, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 3 days.

(21) Appl. No.: 12/481,167

(22) Filed: Jun. 9, 2009

(65) Prior Publication Data

US 2010/0311255 A1 Dec. 9, 2010

(51) Int. Cl.
*H01R 12/00* (2006.01)

(52) U.S. Cl. ..... 439/67; 439/82

(58) Field of Classification Search ..... 439/66, 439/67, 82, 97

See application file for complete search history.

(56) References Cited

U.S. PATENT DOCUMENTS 3,670,409 A * 6/1972 Reimer ..... 29/853
4,950,173 A * 8/1990 Minemura et al. ..... 439/82
5,620,290 A * 4/1997 Homfeldt et al. ..... 411/533
6,198,630 B1 3/2001 Cromwell
6,711,810 B2 * 3/2004 Buley et al. ..... 29/830
6,945,788 B2 9/2005 Trout et al.
7,044,755 B2 * 5/2006 Hatakeyama ..... 439/97
7,056,131 B1 6/2006 Williams
7,059,869 B2 * 6/2006 Wertz et al. ..... 439/71
7,070,419 B2 7/2006 Brown et al.
7,090,507 B2 8/2006 Wertz et al.
7,113,408 B2 9/2006 Brown et al.
7,118,385 B1 10/2006 Bodenweber et al.
7,371,073 B2 5/2008 Williams
7,381,060 B2 * 6/2008 Ju ..... 439/66
7,435,099 B2 * 10/2008 Kirkus ..... 439/66
7,445,462 B2 * 11/2008 Kim ..... 439/67

* cited by examiner

*Primary Examiner* — Thanh-Tam T Le

(57) ABSTRACT

An electrical connector for electrically coupling an electronic module and an electrical component. The connector includes a connector body that has first and second mating surfaces. The connector body includes interconnects that extend through the connector body between the first and second mating surfaces for electrically coupling the module and the component. The connector body has a hole extending therethrough along a central axis. The hole is configured to receive a guide pin from one of the module and the component. The connector also includes surface mount projections that are coupled to the connector body and extend toward the central axis of the hole. The projections engage and flex against the guide pin when the guide pin is inserted into the hole. The projections form an interference fit with the guide pin to hold the connector body in a mounted position.

19 Claims, 7 Drawing Sheets

ELECTRICAL CONNECTOR HAVING AT LEAST ONE HOLE WITH SURFACE MOUNT PROJECTIONS

BACKGROUND OF THE INVENTION

The invention relates generally to electrical connectors, and more particularly to electrical connectors with mechanisms for at least one of aligning and retaining mating contacts in a board-to-board electrical connection.

Surface mount technologies, such as land-grid array (LGA) assemblies and ball-grid array (BGA) assemblies, involve mounting an electronic module onto a printed circuit board (PCB). For example, in an LGA assembly, the module is mounted onto an interposer, which, in turn, is mounted onto a PCB. The module and the PCB each have mating contacts along their respective surfaces that mate with the interposer, and the interposer has conductive pathways that electrically couple the mating contacts of the module to corresponding mating contacts of the PCB. In some conventional LGA assemblies, the modules include pins that extend outwardly away from the module. When the module is mounted onto the interposer, the pins are inserted through holes in the interposer and then into holes in the PCB. In other embodiments, the interposer or the PCB includes pins that are inserted into corresponding holes of the module.

However, the pins, interposer, and/or PCB are typically constructed from a rigid material. If the dimensions or locations of the holes are not precisely manufactured to specification, the components may be unable to mate with each other or may not be properly aligned when mated. Furthermore, forcing the pins into corresponding holes when not properly aligned may damage the components.

Accordingly, there is a need for a connector or connector assembly where an electronic module may be properly aligned and mounted onto an interposer. Furthermore, there is a need for alternative methods and features that facilitate aligning and mounting the components of a connector assembly.

BRIEF DESCRIPTION OF THE INVENTION

In one embodiment, an electrical connector for electrically coupling an electronic module and an electrical component is provided. The connector includes a connector body that has first and second mating surfaces. The connector body includes interconnects that extend through the connector body between the first and second mating surfaces for electrically coupling the module and the component. The connector body has a hole extending therethrough along a central axis. The hole is configured to receive a guide pin from one of the module and the component. The connector also includes surface mount projections that are coupled to the connector body and extend toward the central axis of the hole. The projections engage and flex against the guide pin when the guide pin is inserted into the hole. The projections form an interference fit with the guide pin to hold the connector body in a mounted position.

In another embodiment, an electrical connector for electrically coupling an electronic module and an electrical component is provided. The connector includes a connector body that has first and second mating surfaces. The connector body includes interconnects that extend through the connector body between the first and second mating surfaces for electrically coupling the module and the component. The connector body has a hole extending therethrough along a central axis. The hole is configured to receive a guide pin from one of the module and the component. The connector also includes a first surface mount projection coupled to the connector body along the first mating surface and extending toward the central axis. The connector also includes a second surface mount projection coupled to the connector body along the second mounting surface and extending toward the central axis. The first and second projections engage the guide pin when the guide pin advances through the hole along a misaligned path. The hole and the guide pin move relative to one another.

In another embodiment, an electrical connector for electrically coupling an electronic module and an electrical component is provided. The connector includes a connector body that has first and second mating surfaces. The connector body includes interconnects that extend through the connector body between the first and second mating surfaces for electrically coupling the module and the component. The connector body has a hole extending therethrough along a central axis. The hole is configured to receive a guide pin from one of the module and the component. The connector also includes first surface mount projections coupled to the connector body along the first mating surface and extending into the hole and a second surface mount projection coupled to the connector body along the second mounting surface and extending into the hole. The first and second projections engage the guide pin when the guide pin advances through the hole along a misaligned path. The first projections form an interference fit with the guide pin to hold the module in a mounted position.

DETAILED DESCRIPTION OF THE INVENTION

Figure 1:
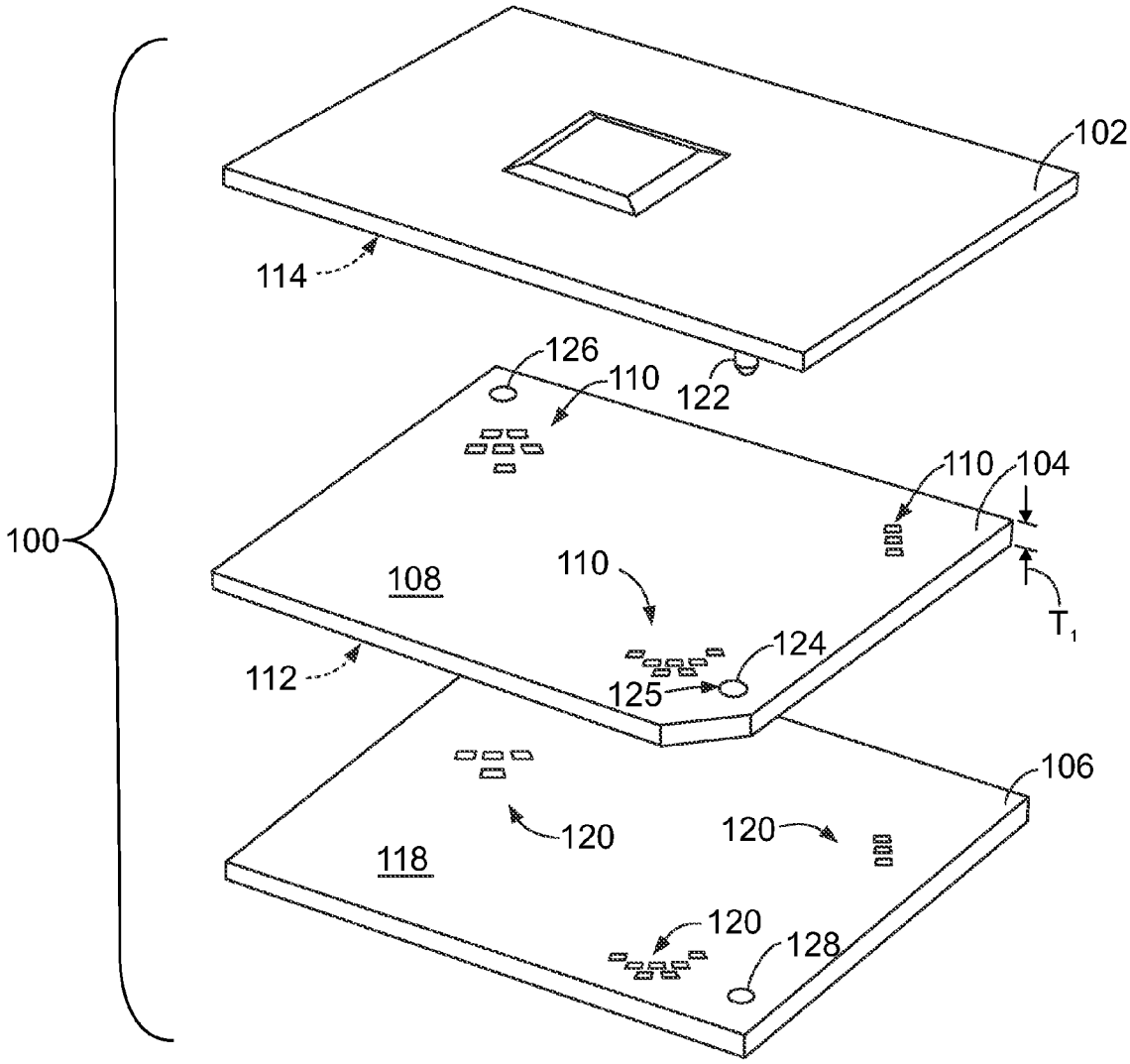
FIG. 1 is an exploded view of an electrical connector assembly formed in accordance with one embodiment.

FIG. 1 is an exploded view of an electrical connector assembly 100 formed in accordance with one embodiment. The connector assembly 100 includes an electronic module 102, an electrical connector 104, and an electrical component 106, which is illustrated as a printed circuit board (PCB) but may be other electrical components. The module 102 may be a circuit board or another type of electronic package that is configured to perform one or more functions. The connector 104 may be, for example, a socket connector or an interposer having a thickness $T_1$ and an array of interconnects 110 extending therethrough. The connector 104 may include a first or top mating surface 108 that is configured to engage the module 102 and a second or bottom mating surface 112 that is configured to engage the electrical component 106. The module 102 may have a mating face 114 configured to engage the mating surface 108 of the connector 104. The electrical component 106 may also have a mating face 118 including an array of mating contacts 120 thereon. When the connector assembly 100 is fully assembled, the module 102, the connector 104, and the electrical component 106 are stacked upon each other. The interconnects 110 electrically couple the module 102 and the electrical component 106 in communication with each other.

As will be discussed in greater detail below, the connector assembly 100 may include one or more mounting features having one or more surface mount projections. As used herein, a "mounting feature" facilitates at least one of aligning and holding (or retaining) an electrical connector with respect to at least one of a module and an electrical component in order to establish or maintain an electrical connection. The mounting feature may be coupled to a surface of the connector. A "surface mount projection," as used herein, is a structural element of a mounting feature that engages one of the module and the component. For example, surface mount projections may be shaped like fingers, flanges, fins, tabs, a ring, and the like.

By way of an example, the connector 104 may have holes 124 and 126 that extend through the connector 104. The electrical component 106 also has a hole 128 and another hole (not shown) located diagonally across the electrical component 106. The holes of the electrical component 106 are configured to align with corresponding holes 124 and 126 of the connector 104. The module 102 may have one or more guide pins 122 that project away from the mating face 114 and are configured to be inserted into the aligned holes 124 and 126 when the module 102 is mounted onto the connector 104 and the electrical component 106. The connector 104 includes one or more surface mount projections 125 that are proximate to and extend into the holes 124 and 126. The projections 125 may be coupled to the mating surface(s) 108 and/or 112 and are configured to engage a corresponding guide pin 122 as the guide pin 122 is entering and/or advancing through the corresponding hole. The projections 125 facilitate aligning the module 102 and the connector 104 into mounted positions with respect to each other. In the mounted position, each of the module 102 and the connector 104 have a predetermined position and orientation relative to each other. Furthermore, the projections 125 may also function as a retention mechanism by holding the connector 104 and the module 102 in the mounted position during usage of the connector assembly 100.

As shown in FIG. 1, the module 102, the connector 104, and the electrical component 106 have rectangular bodies of substantially equal shape and size. However, in alternative embodiments, the module 102, the connector 104, and the electrical component 106 may have different shapes and sizes. For example, the electrical component 106 may have a much greater length and width such that several pairs of electrical connectors and electronic modules may be mounted thereon.

Figure 2:
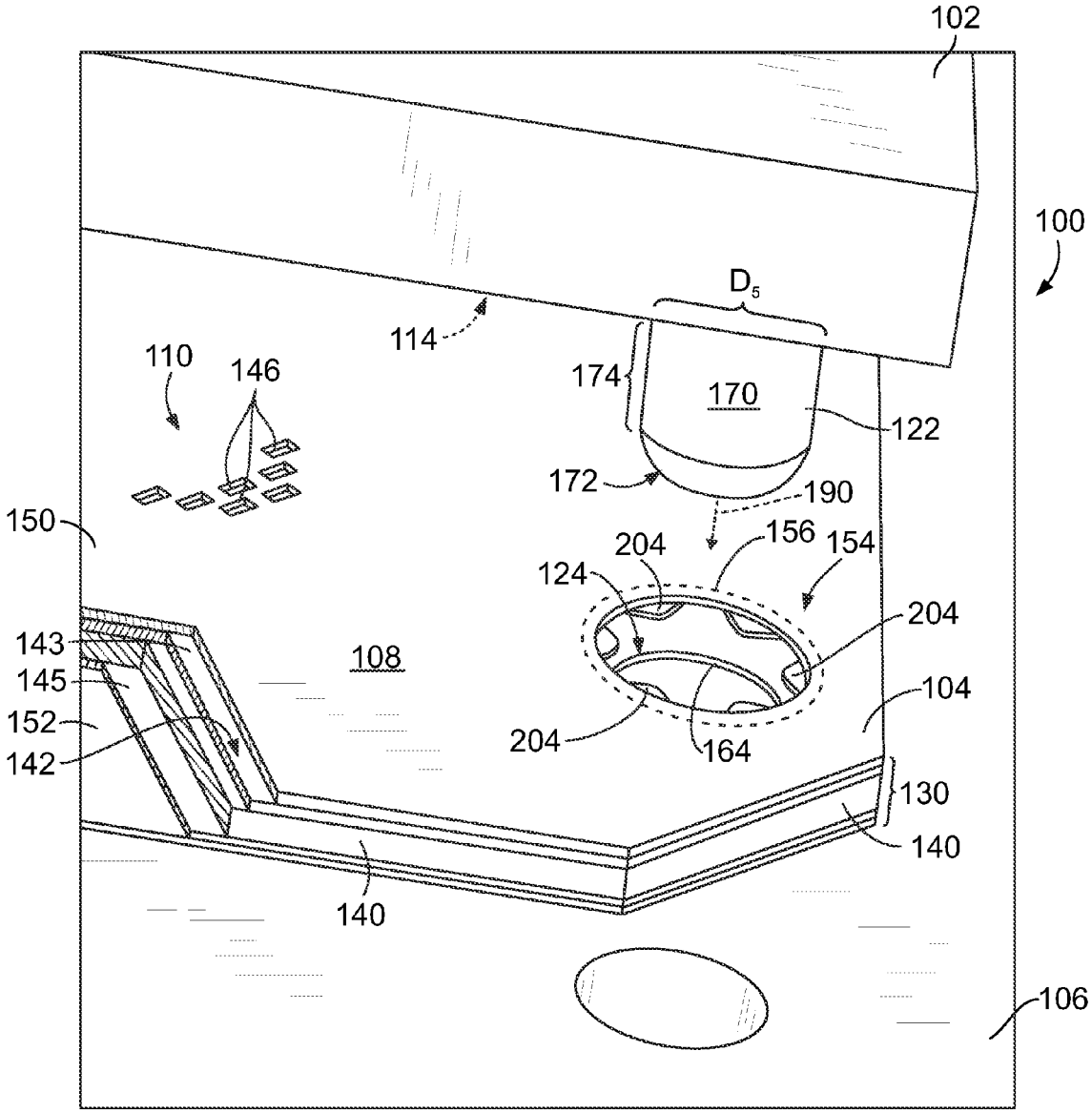
FIG. 2 is an exploded perspective view of the connector assembly shown in FIG. 1 with an electronic module, an electrical connector, and an electrical component about to be mounted together.
Figure 7:
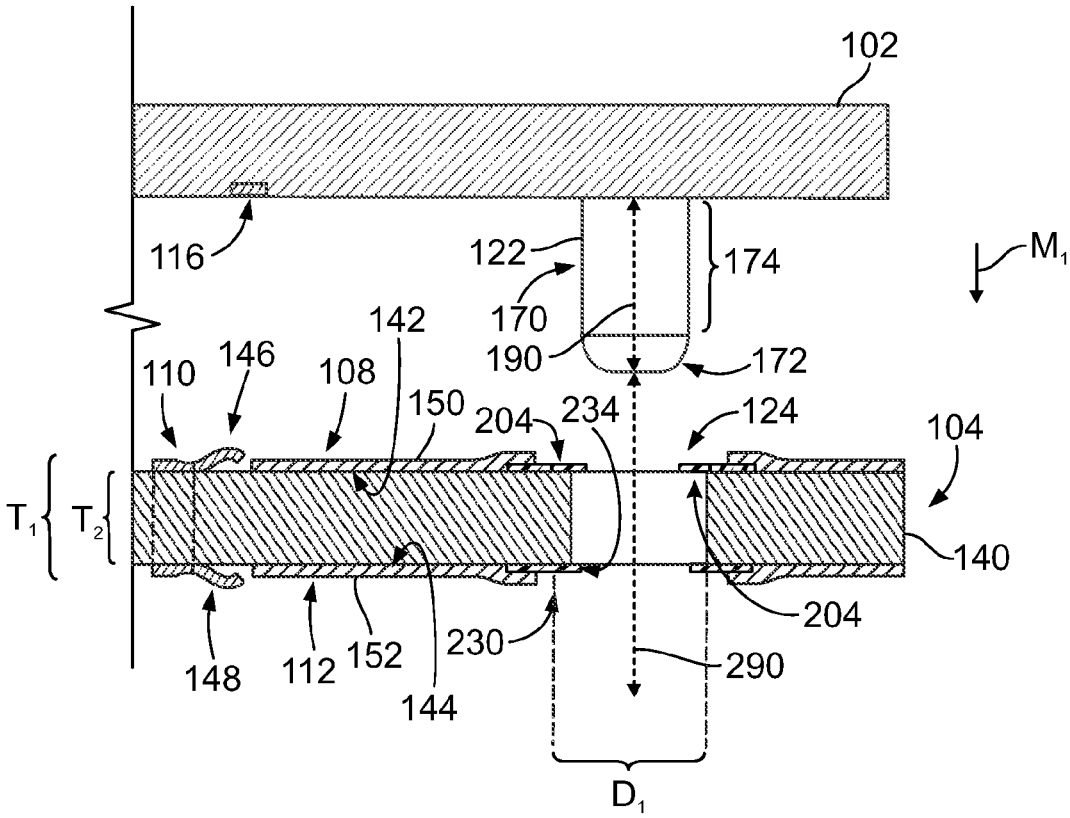
FIG. 7 is a cross-sectional view of the module and the connector before the module is mounted onto the connector.

FIG. 2 is an exploded perspective view of the connector assembly 100 with the module 102, the connector 104, and the electrical component 106 about to be mounted together. The connector 104 includes a connector body 130 that may have multiple layers. The connector body 130 may include a top cover layer 150, an optional conductive material layer 143, a substrate 140 having top and bottom side surfaces 142 and 144 (side surface 144 is shown in FIG. 7), another optional conductive material layer 145, and a bottom cover layer 152. The substrate 140 may be fabricated from a non-conductive or PCB-like material and be sandwiched between the conductive material layers 143 and 145, which may be sandwiched between the cover layers 150 and 152. Also shown, the mating surface 108 may include a plurality of contacts 146 there along. The contacts 146 may be formed on the side surface 142 of the substrate 140 from the conductive material 143 during, for example, an etching or lithographic process. The contacts 146 may be part of the interconnects 110 that extend through the substrate 140.

During the above etching or lithographic process, mounting features 154 and 164 may be formed from the conductive material layers 143 and 145, respectively, near the hole 124. The mounting feature 154 may include a ring portion 156 (indicated by the hashed lines in FIG. 2) that is under the cover layer 150. The mounting feature 154 may also include a plurality of surface mount projections 204 that project toward a center of the hole 124 from the ring portion 156. Since the mounting feature 154 may be formed from the conductive material 143 that forms the contacts 146 and through the same process, the mounting feature 154 and, more specifically, the projections 204 may have a uniform thickness and/or a common material with respect to the contacts 146. However, in alternative embodiments, the mounting feature 154 is not formed along with the contacts 146, but through a separate process and/or material.

After the contacts 146 are formed on the side surface 142, the cover layer 150 may be applied. The cover layer 150 may be a thin, semi-rigid material, for example, that includes an adhesive that bonds to the substrate 140. The cover layer 150 may include openings that are similar in position and size to the underlying contacts 146, the ring portion 156 of the mounting feature 154, and the hole 124. The openings may be made in the cover layer 150 before or after the cover layer is applied to the side surface 142. Furthermore, the cover layer 150 may be designed to encapsulate portions of the contacts 146 and the mounting feature 154 in predetermined regions. For example, the cover layer 150 may cover a base portion (not shown) of each contact 146 that is bonded or affixed to the side surface 142. In such embodiments, the cover layer 150 may restrain the corresponding contacts 146 against the side surface 142 and facilitate holding the contacts 146 in position when the module 102 engages the connector 104. However, alternative embodiments of the connector 104 may not include the cover layer 150.

Also shown in FIG. 2, the guide pin 122 may protect from the mating face 114 of the module 102 toward the connector 104. The guide pin 122 may include a base 174 that extends along a central axis 190. The base 174 may have a lateral surface 170 that faces radially outward from the central axis 190. The base 174 extends from the mating face 114 to a distal end 172. The guide pin 122 has a cross-section configured to be inserted in the hole 124. For example, in FIG. 2 the base 174 has a circular cross-section that is sized and shaped to be inserted into the hole 124. The cross-section may have a diameter $D_5$. However, in alternative embodiments, the hole 124 and the guide pin 122 may have other cross-sectional shapes, such as a triangle, square, rectangular, or half-circle. Furthermore, the cross-section of the guide pin 122 at the distal end 172 may taper or narrow as the distal end 172 extends from the base 174 and away from the mating face 114. For example, the distal end 172 may be rounded or dome-shaped. However, in alternative embodiments, the distal end 172 may be flat, pyramidal, or other shapes.

Figure 3:
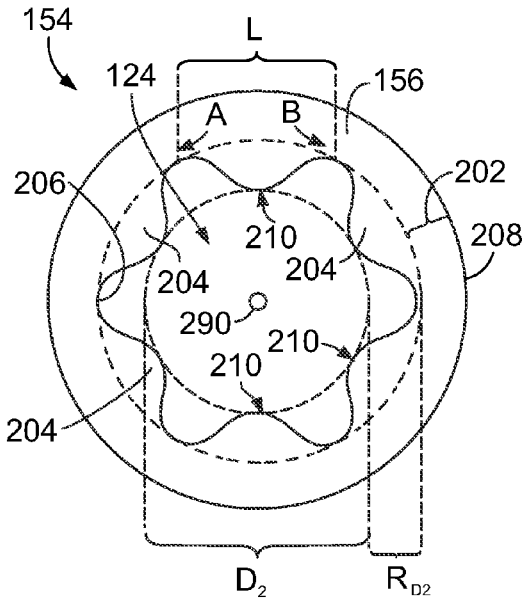
FIG. 3 is an enlarged plan view of surface mount projections that may be used with the connector shown in FIG. 2.
Figure 4:
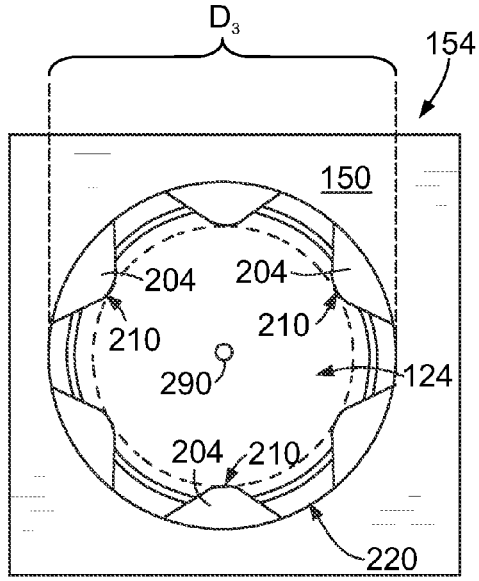
FIG. 4 is an enlarged plan view of the projections in FIG. 3 partially covered by a cover layer.

FIGS. 3 and 4 illustrate the mounting feature 154 in greater detail. FIG. 3 is a top plan view of the mounting feature 154 without the cover layer 150 (FIG. 2) applied to the side surface 142 (FIG. 2). The hole 124 may have a uniform cross-section extending through the connector body 130 (FIG. 2). As shown, the hole 124 may extend along a central axis 290 and have a diameter $D_1$ (shown in FIG. 7). The mounting feature 154 may include a ring portion 156 that extends around the hole 124 with the central axis 290 extending through a center of the ring portion 156. As such, the ring portion 156 may be concentric with respect to the hole 124. The ring portion 156 extends between an outer edge 208 and an inner edge 206 and may have a rim 202 that is directly coupled to the side surface 142.

The plurality of projections 204 extend toward the central axis 290 from the ring portion 156. As used herein, the phrase "extending toward" includes the projection 204 heading inward in the general direction of the central axis 290 such that the shortest distance between the central axis 290 and the corresponding projection 204 is less than the shortest distance between the central axis 290 and a part of the ring portion 156 from which the corresponding projection 204 extends. In some embodiments, the projections 204 may extend directly toward the central axis 290 as shown in FIGS. 2-4. Each projection 204 may narrow or taper as the projection 204 extends from the ring portion 156 to a tip 210. For example, an arcuate length L may extend between two ends A and B along a base of each projection 204. The arcuate length L of each projection 204 may be $1/6^{th}$ of the total arcuate length (i.e., total circumference) of the circle formed by the edge 206 such that six projections 204 project from the ring portion 156. The projections 204 may be evenly distributed about the central axis 290. Furthermore, the tip 210 may be substantially centered between the two ends A and B of the arcuate length L and extend a radial distance $R_{D2}$ away from the ring portion 156. The tips 210 of the projections 204 may also be evenly distributed about the central axis 290. The tips 210 may define a circle that has a diameter $D_2$. The diameter $D_2$ is less than the diameter $D_1$ of the hole 124 and may be less than the diameter $D_5$ (FIG. 2) of the guide pin 122 (FIG. 2).

The projections 204 may be formed from a material and have dimensions that are sized and shaped so that the projections 204 have a predetermined flexing force that pushes or redirects the guide pin 122 inward toward the central axis 290. In some embodiments, the projections 204 may form an interference fit with the guide pin 122. For example, the projections 204 may form an interference fit that supports a weight of the connector 104 (FIG. 1) in order to retain the connector 104 to the module 102. By way of example only, the projections 204 may provide about 200-400 grams in retention force. Furthermore, the projections 204 may partially deform when the guide pin 122 is inserted into the hole 124 or the projections 204 may be resiliently flexible and return to an uncompressed state when the guide pin 122 is removed. In some embodiments, the projections 204 may extend toward the central axis 290 along a plane that is perpendicular to the central axis 290 (i.e., the projections 204 extend parallel to the side surface 142). In other embodiments, the projections 204 may project into the hole 124 at a non-orthogonal angle with respect to the central axis 290.

In alternative embodiments, there may be fewer or more projections 204 as shown. The projections 204 may also have other shapes. For example, the projections 204 may be substantially square- or rectangular-shaped tabs that project from the edge 206. Each projection 204 may have a similar shape as the other projections 204 or may be different than the others. Furthermore, the ring portion 156 may have other shapes than as shown in FIG. 3. As one example, the hole 124 may have a square-shaped cross-section. In such embodiments, the ring portion 156 may also be square- or rectangular-shaped and extend along the perimeter of the square-shaped hole. The projections may project toward a central axis that extends through the hole.

Furthermore, although the projections 204 are described above as redirecting the guide pin 122, those having ordinary skill in the art understand that the connector 104 may also be redirected by the projections 204 if the guide pin 122, for example, is in a fixed position as the connector 104 is moved toward the module 102. As such, the projections 204 and the guide pin 122 are configured to engage each other to align the guide pin 122 with the hole 124 as the connector 104 and the module 102 are mated. The projections 204 and the guide pin 122 may engage each other to move the guide pin 122 relative to the connector 104 or, more specifically, the hole 124. In other words, the interaction between the guide pin 122 and the projections 204 may move the connector 104 and the module 102 into a desired mateable position with respect to each other.

FIG. 4 is a top plan view of the mounting feature 154 when the cover layer 150 has been applied. As shown, the cover layer 150 forms an opening 220 that may have larger dimensions than the hole 124. For example, the opening 220 may be substantially circular and have a diameter $D_3$. The diameter $D_3$ may be greater than the diameter $D_1$ (FIG. 7) formed by the hole 124. Furthermore, the opening 220 may be concentric with the hole 124 such that the central axis 290 extends through a center of the opening 220. As discussed above, the cover layer 150 may be bonded to the side surface 142 (FIG. 2) and facilitate holding the mounting feature 154 in position. As shown in FIG. 4, the projections 204 may project into the opening 220 such that the tips 210 are exposed and partially obstruct a pathway of the guide pin 122 through the hole 124.

Figure 5:
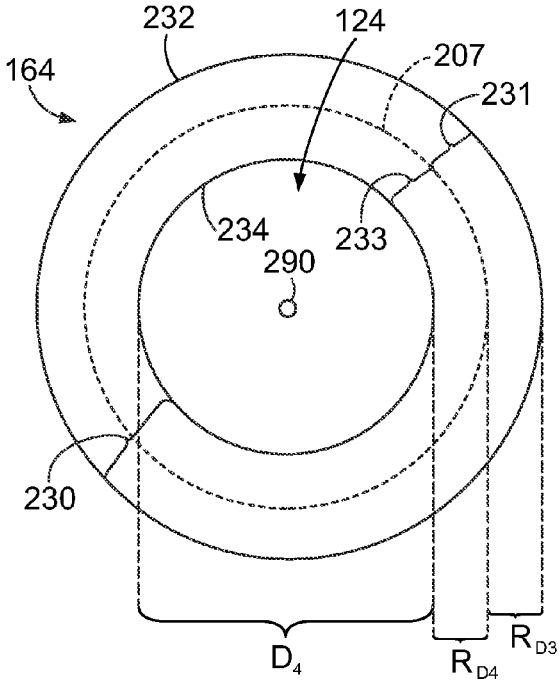
FIG. 5 is an enlarged plan view of another projection that may be used with the connector shown in FIG. 2.
Figure 6:
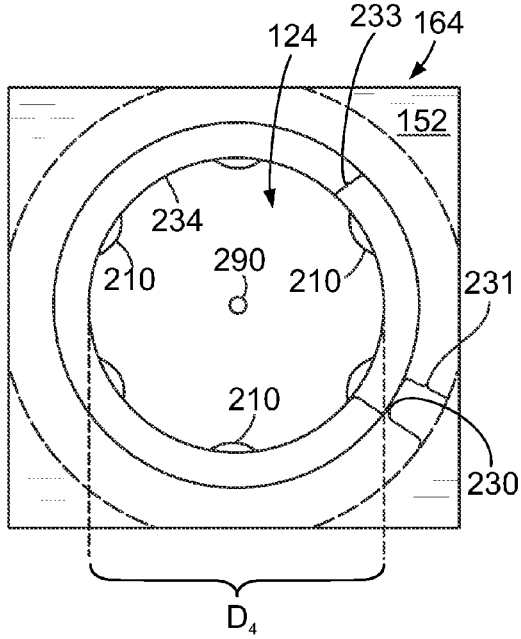
FIG. 6 is an enlarged plan view of the projection in FIG. 5 partially covered by a cover layer.

FIGS. 5 and 6 show the mounting feature 164 in greater detail. The mounting feature 164 is positioned proximate to the hole 124 on the side surface 144 (shown in FIG. 7). FIG. 5 is a plan view of the mounting feature 164 when the cover layer 152 (shown in FIG. 6) is not applied to the side surface 144. The mounting feature 164 may be formed in a similar manner as discussed above with respect to the mounting feature 154. As shown, the mounting feature 164 includes a surface mount projection, which is indicated as a ring 230, that extends around the hole 124. The ring 230 is defined between an outer edge 232 and an inner edge 234. The ring 230 may include a lip portion 233 that surrounds the central axis 290 and a rim portion 231 that surrounds the lip portion 233. The rim portion 231 many be directly coupled to the side surface 144 and extend a radial distance $R_{D3}$ from the outer edge 232 to a hole edge 207 of the hole 124. (A hashed line in FIG. 5 indicates an outline of the hole edge 207 underneath the mounting feature 164.) The lip portion 233 may extend a radial distance $R_{D4}$ from the rim portion 231 to the inner edge 234 and is configured to engage the guide pin 122 (FIG. 2) when the guide pin 122 advances along a misaligned path. As such, the lip portion 233 extends beyond the hole edge 207 toward the central axis 290.

FIG. 6 is a plan view of the mounting feature 164 when the cover layer 152 is applied. The inner edge 234 of the ring 230 has a diameter $D_4$. The diameter $D_4$ may be greater than the diameter $D_2$ (FIG. 3) formed by the tips 210. As shown in FIG. 6, the tips 210 may extend beyond the inner edge 234 toward the central axis 290. The diameter $D_4$ may be slightly greater than the diameter $D_5$ (FIG. 2) of the guide pin 122 such that diameter $D_4$ is sized and shaped to narrowly allow the guide pin 122 to be advanced therethrough.

As shown in FIGS. 3-6, the ring portion 156 of the mounting feature 154 and the ring 230 of the mounting feature 164 completely encircle or surround the central axis 290. However, in alternative embodiments, the ring portion 156 and the ring 230 may only surround a portion of the central axis. Also, the mounting feature 154 may include projections that extend from one common ring portion that only surrounds a portion of the hole 124 or each projection may extend from a separate corresponding ring portion. The ring portion(s) may be directly coupled to the side surface 142 to support the projections.

FIG. 7 is a cross-sectional view of the module 102 and the connector 104 before the module 102 is mounted onto the connector 104. As shown, the connector 104 may be an interposer that includes the interconnects 110 and cover layers 150 and 152. The substrate 140 may have the side surfaces 142 and 144 with a thickness $T_2$ extending therebetween. The interconnects 110 (only one interconnect 110 is shown in FIG. 7) may form conductive pathways between the mating surfaces 108 and 112. Specifically, each interconnect 110 may include contacts 146 and 148 and a via 134 extending therebetween that communicatively couples the contacts 146 and 148. To manufacture the contacts 146 and 148, the conductive material layer 143 (FIG. 2) may be applied to the side surfaces 142 and 144. The contacts 146 and 148 may be formed and isolated from each other through the etching or lithographic process discussed above.

The interconnects 110 provide a conductive pathway so that corresponding mating contacts on the module 102 and the electrical component 106 may communicate with each other therebetween. The contacts 146 and 148 may be resilient beams that flex away from the corresponding mating surface or side surface. Alternatively, the contacts 146 and/or 148 may be contact pads or protrusions. When the connector 104 includes the cover layers 150 and 152, the contacts 146 and 148 are in some way exposed to the exterior environment. For example, holes or openings may be formed within the cover layers 150 and 152 so that the contacts 146 and 148 may project beyond the corresponding cover layer. The contacts 146 are configured to engage the mating contacts 116 of the module 102, and the contacts 148 are configured to engage the mating contacts 120 of the electrical component 106 (both shown in FIG. 8).

The interconnects 110 may have various configurations for providing a conductive pathway. For example, in alternative embodiments the contacts 146 and 148 may not be single beams, but may be, for example, contact pads, solder balls, or dual-beams. Furthermore, in alternative embodiments, the substrate 140 may include cavities where flexible socket contacts are located. The socket contacts may include, for example, a solder ball that is configured to couple to the electrical component 106 and a beam that projects out of the cavity to engage the module 102.

To mount the module 102 to the connector 104, the guide pin 122 may be aligned with the hole 124. More specifically, the central axis 190 that extends along the base 174 of the guide pin 122 is aligned with the central axis 290 that extends through the hole 124. The module 102 may be moved in a mounting direction (indicated by the arrow $M_1$) such that the guide pin 122 is moved toward the hole 124. Alternatively, the connector 104 may be moved toward the module 102 in a direction that is opposite to the mounting direction $M_1$. The distal end 172 of the guide pin 122 is first inserted into the hole 124. As the guide pin 122 advances through the hole 124, the projections 204 may engage the distal end 172 or the lateral surface 170 of the guide pin 122. In the illustrated embodiment, the projections 204 engage the guide pin 122 whether or not the guide pin 122 is advancing along a misaligned path. However, in alternative embodiments, the projections 204 may only engage the guide pin 122 if the central axis 190 of the guide pin 122 is not aligned (i.e., misaligned) with the central axis 290 of the hole 124.

The projections 204 may be configured to resiliently flex against the guide pin 122 to facilitate aligning the guide pin 122 within the hole 124 (i.e., aligning the central axis 190 of the guide pin 122 with the central axis 290 of the hole 124). When the distal end 172 clears the projections 204 and approaches the ring 230 within the hole 124, the distal end 172 may either clear the inner edge 234 of the ring 230 or may engage the inner edge 234. The distal end 172 may be shaped such that if the inner edge 234 engages the distal end 172, the distal end 172 slides along the inner edge 234. The inner edge 234 forces the guide pin 122 into alignment with the hole 124. As such, the projections 204, the distal end 172, and the inner edge 234 may cooperate with one another in aligning the guide pin 122 within the hole 124.

Figure 8:
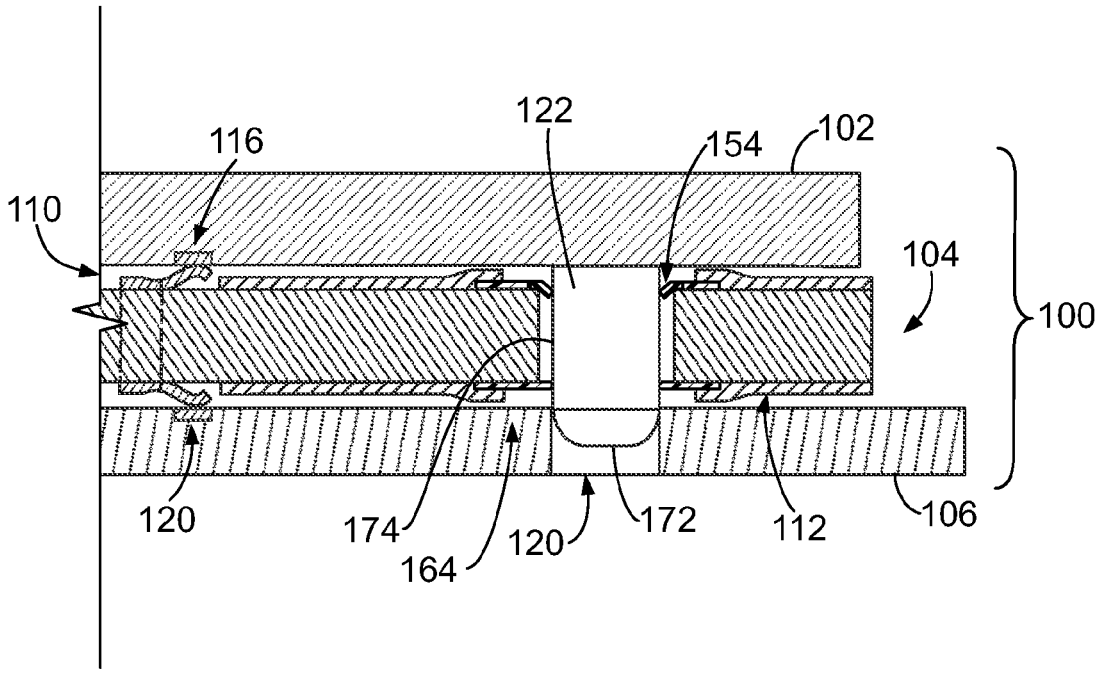
FIG. 8 is a cross-sectional view of the module mounted onto the connector and the electrical component.

FIG. 8 is a cross-sectional view of the connector assembly 100 when all of the components of the connector assembly 100 are mounted together. After the module 102 is mounted onto the connector 104, the distal end 172 and a portion of the base 174 may project outward from the mating surface 112. The connector 104 may then be mounted onto the electrical component 106 by inserting the guide pin 122 into the hole 128 of the electrical component 106. As shown, when the module 102, the connector 104, and the electrical component 106 are properly mounted, the interconnect 110 forms a conductive pathway so that the mating contacts 116 and 120 are communicatively coupled to one another.

The shape and dimensions of the mounting features 154 and 164 or the projections 204 may be configured to have desired properties and characteristics. As such, the diameters $D_1$-$D_4$ and radial distances $R_{D2}$ and $R_{D3}$, which are described above with respect to FIGS. 3-6, may have various configurations. For example, the rim 202 (FIG. 3) and radial distance $R_{D3}$ may be increased to provide additional support for the inwardly extending projections 204 (FIG. 3) and lip portion 233 (FIG. 5), respectively. The diameter $D_1$ of the hole 124 (FIG. 3) may be increased with respect to the diameter $D_5$ of the guide pin 122 (both shown in FIG. 2). Such an embodiment may facilitate assembling the connector assembly 100 (FIG. 1) because the target for inserting the guide pin 122 into the hole 124 is greater. The above examples are not intended to be limiting and other configurations of the dimensions may be used.

Figure 9:
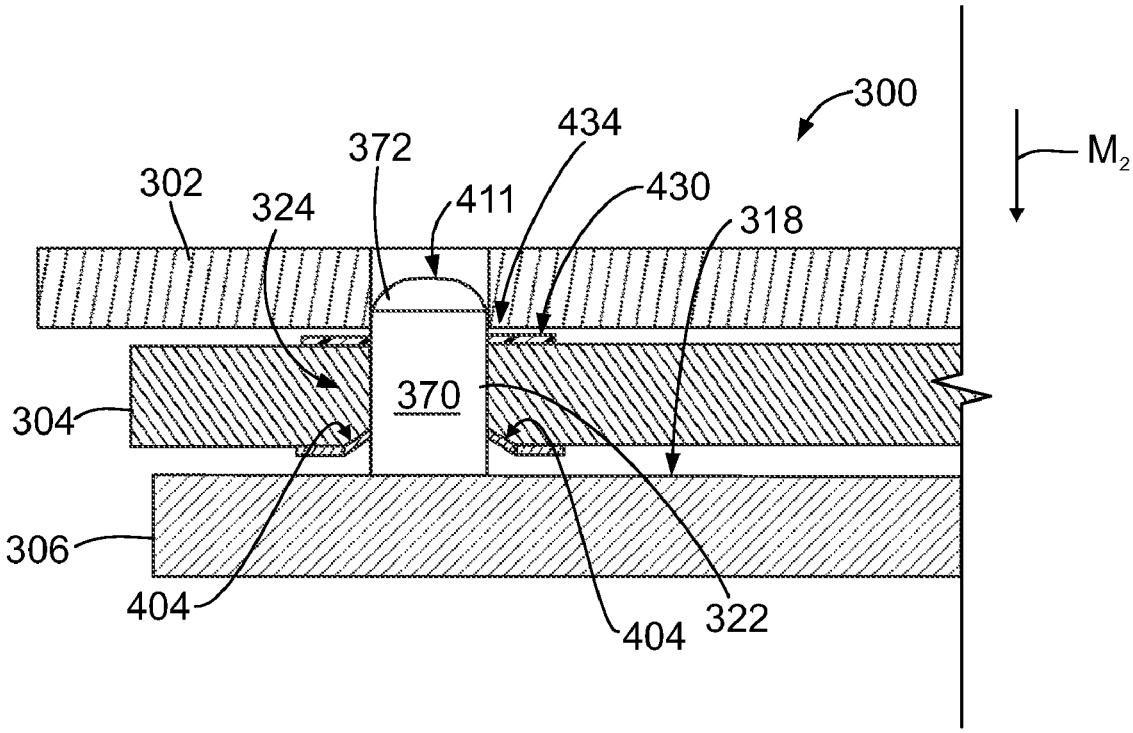
FIG. 9 is a cross-sectional view of an electrical connector assembly formed in accordance with an alternative embodiment.

FIG. 9 is a cross-sectional view of an electrical connector assembly 300 formed in accordance with an alternative embodiment. The connector assembly 300 may include similar parts and components as the connector assembly 100. The connector assembly 300 may include a guide pin 322 that extends from a mating face 318 of an electrical component 306. When a connector 304 is aligned with the guide pin 322, the connector 304 may be moved in a mounting direction (indicated by the arrow $M_2$) such that a hole 324 of the connector 304 is moved toward the guide pin 322. A distal end 372 first advances into the hole 324. As the guide pin 322 advances through the hole 324, projections 404 may engage the distal end 372 or a lateral surface 370 of the guide pin 322. The projections 404 may resiliently flex against the guide pin 322 to facilitate aligning the guide pin 322 within the hole 324. As the distal end 372 approaches a ring 430, the distal end 372 may clear an inner edge 434 of the ring 430 or may engage the inner edge 434. Similar to the embodiment described with reference to FIGS. 7 and 8, the projections 404, the distal end 372, and the inner edge 434 may cooperate with one another in aligning the guide pin 322 within the hole 324. After the connector 304 is mounted onto the electrical component 306, a portion of the guide pin 322 may project outward from the connector 304. The module 302 may then be mounted onto the connector 304 by inserting the guide pin 322 into a hole 411 of the module 302.

Figure 10:
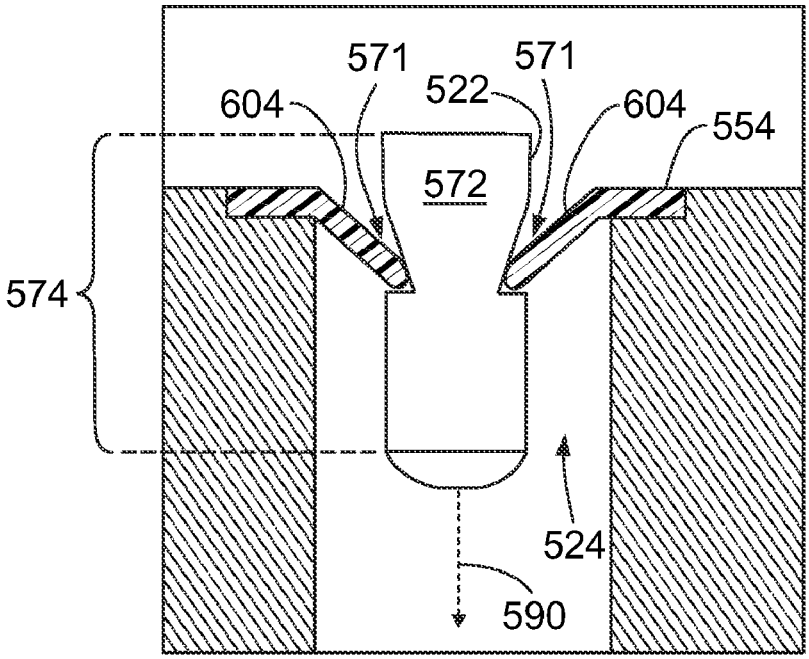
FIG. 10 is an enlarged cross-sectional view of surface mount projections engaging a guide pin formed in accordance with another embodiment.

FIG. 10 is an enlarged cross-sectional view of an projection 554 engaging a guide pin 522 formed in accordance with another embodiment. In some embodiments, the projections described herein may not only facilitate aligning the module, the connector, and the electrical component with respect to each other, but may also include retention features that facilitate retaining or holding the connector in the mounted position. FIG. 10 illustrates such an embodiment. As shown, a guide pin 522 is configured to be inserted into a hole 524. The guide pin 522 may include a base 574 that extends along a central axis 590. The base 574 has an outer lateral surface 572 that may include indentations or notches 571 that are configured to engage projections 604 of an projection 554. The notches 571 may extend entirely around a circumference of the base 574 or, alternatively, may extend around only a portion of the base 574. As the guide pin 522 is inserted through the hole 524, the projections 604 engage and slide along the lateral surface 572. When the projections 604 clear the notches 571, the projections 604 may resiliently flex into the recesses formed by the notches 571.

FIGS. 11-14 illustrate surface mount projections and cover layers formed in accordance with alternative embodiments. The surface mount projections and the cover layer may have various configurations and geometries surrounding the hole for aligning and/or holding a guide pin. For example, FIGS. 11A and 11B illustrate a perspective cross-section and an outlined plan view, respectively, of a cover layer 702 and a plurality of surface mount projections 704 proximate to a hole 703. As shown, the hole 703 is defined by a wall surface 706 that surrounds a central axis 705. The projections 704 project toward the central axis 705 and are configured to engage a guide pin (not shown) when the guide pin advances through the hole 703. More specifically, the projections 704 are arcuate and T-shaped and include a base portion 708 and an engagement portion 710. The base portion 708 has an arcuate width $W_2$ that is less than an arcuate width $W_3$ of the engagement portion 710. In such embodiments, a thinner base portion 708 may provide more flexibility of the projection 704 and a wider engagement portion 710 may provide more contact and friction with the guide pin. Also shown, the cover layer 702 may have an opening 712 that is approximately equal in size and shape to an opening of the hole 703.

Figure 12A:
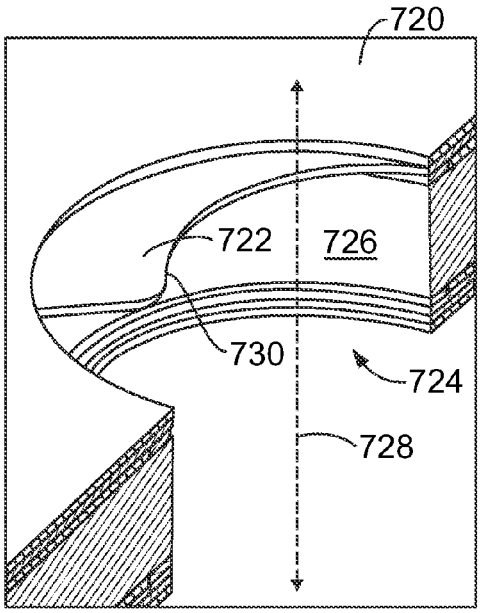
Figure 12B:
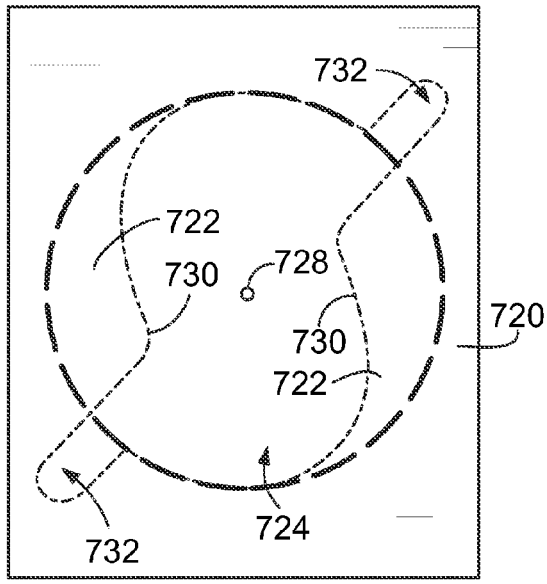

FIGS. 12A and 12B illustrate a perspective cross-section and an outlined plan view, respectively, of a cover layer 720 and a plurality of surface mount projections 722 proximate to a hole 724. As shown, the hole 724 is defined by a, wall surface 726 that surrounds a central axis 728. The projections 722 project toward the central axis 728 and are configured to engage a guide pin (not shown) when the guide pin advances through the hole 724. More specifically, the projections 722 may be fin-shaped having an edge 730 that curves inward toward the central axis 728 as the edge 730 extends around the central axis 728. For example, the edge 730 may have a radius of curvature that is less than a radius of curvature of the wall surface 726. Also shown, the projections 722 may form cutouts 732 underneath the cover layer 720.

Figure 11A:
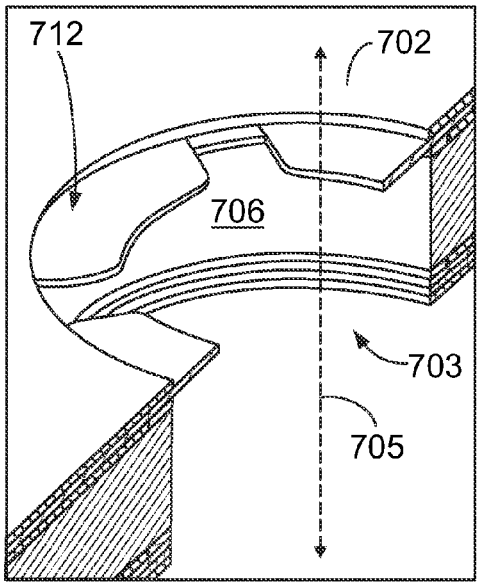
FIGS. 11-14 illustrate surface mount projections and cover layers formed in accordance with alternative embodiments.
Figure 11B:
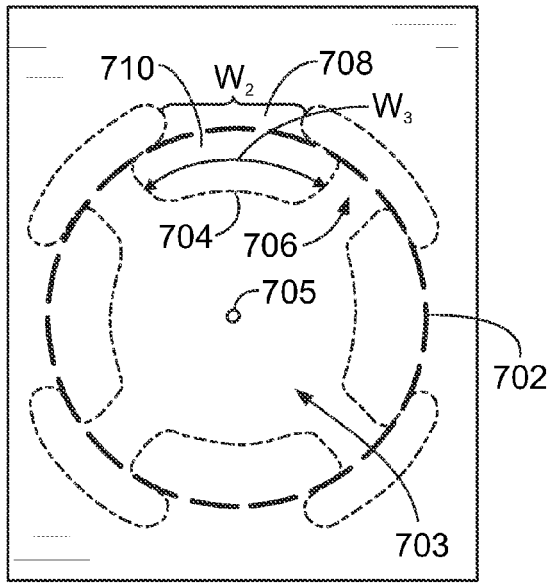
Figure 13A:
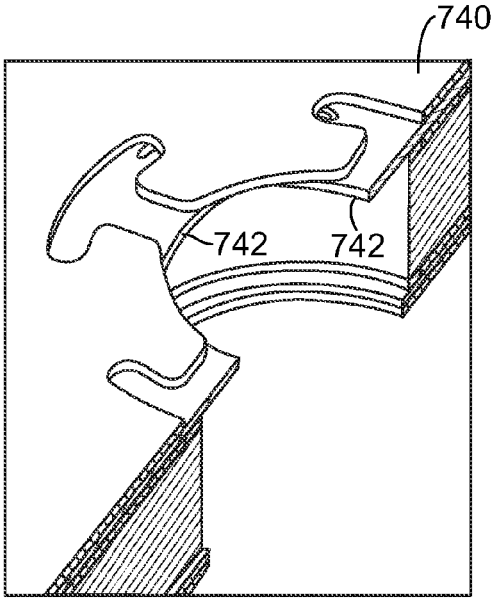
Figure 13B:
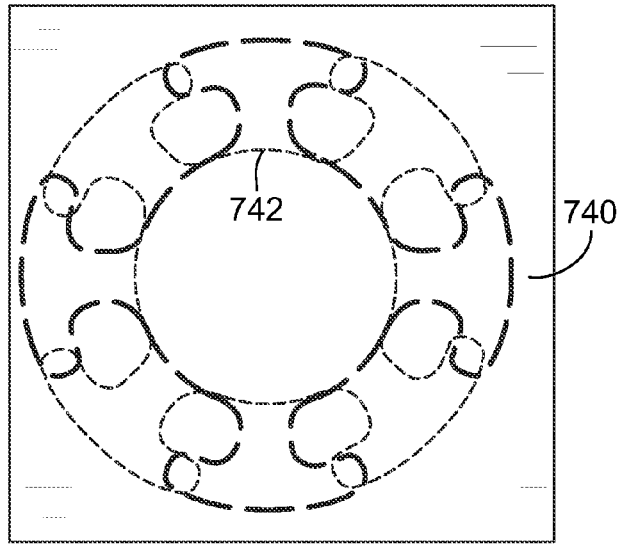
Figure 14A:
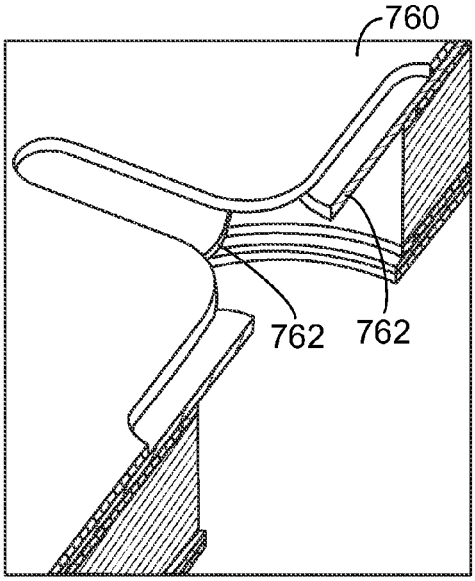
Figure 14B:
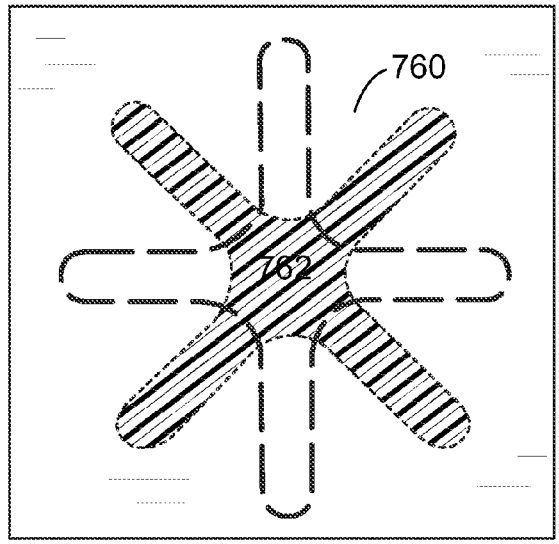

Furthermore, the cover layer may be shaped as desired in order to facilitate the surface mount projections in aligning and holding a guide pin (not shown). For example, FIGS. 13A and 13B illustrate a perspective cross-section and an outlined plan view, respectively, of a cover layer 740 and a plurality of surface mount projections 742. The projections 742 are similarly shaped as the projections 704 (FIGS. 11A and 11B). As shown, the cover layer 740 may be shaped to overlap portions of adjacent projections 742. As another example, FIGS. 14A and 14B illustrate a perspective cross-section and an outlined plan view, respectively, of a cover layer 760 and a plurality of surface mount projections 762. The projections 762 are similarly shaped as the projections 204, but have larger dimensions. Again, the cover layer 760 may be shaped to overlap portions of adjacent projections 762. In such embodiments, the cover layer may work in conjunction with the projections to align and/or hold a guide pin (not shown).

It is to be understood that the benefits herein described are also applicable to other connectors and connector assemblies. In the illustrated embodiment, the connector assembly 100 (FIG. 1) is a land grid array (LGA) assembly. However, benefits of the features described herein may be used with other surface mount technologies and board-to-board connector assemblies. Furthermore, the connector assembly 100 is not limited to the number or type of parts shown in FIG. 1, but may include or operate in conjunction with additional parts that are not shown, such as a board stiffener, heat sink, and hardware that compresses the components of the connector assembly 100 together.

In addition, embodiments as described herein may include more than one hole having one or more mounting features, such as the mounting features 154 and 164. In such embodiments, the holes may have the same or different shapes with respect to one another. As an example, one hole may have a substantially circular cross-section and the other hole may have an elongated oval-shaped cross-section. Furthermore, the projections corresponding to each hole may have the same or different shapes.

Furthermore, although the preceding discussion is with respect to one mounting feature having projections on one side of the connector body and another mounting feature having a lip portion on the other side of the connector body, it should be understood that either mounting feature may be used on both sides. For example, the mounting features 164 may be used on both side surfaces 142 and 144. Also, in another embodiment, the mounting feature 154 may be used on both side surfaces 142 and 144. In such embodiments, the projections 204 on the bottom mating surface 112 may project into the hole 128 of the electrical component 106. Furthermore, a mounting feature may be formed within the substrate 140 such that projections or a lip portion may be located a depth within the hole 124. Thus, the above description is provided for purposes of illustration, rather than limitation, and is but one potential application of the subject matter herein.

Thus, the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for electrically coupling an electronic module and an electrical component, the connector comprising:

a connector body having first and second mating surfaces and a substrate extending therebetween, the substrate having a conductive material layer deposited thereon, the connector body including interconnects extending through the connector body between the first and second mating surfaces for electrically coupling the module and the component, the interconnects including contacts located along the first mating surface, the connector body having a hole extending therethrough along a central axis, the hole being configured to receive a guide pin from one of the module and the component; and surface mount projections coupled to the connector body along the first mating surface and extending toward the central axis of the hole, the projections being configured to engage and flex against the guide pin when the guide pin is inserted into the hole along a misaligned path;

wherein the contacts and the projections are formed from the conductive material layer, the contacts being isolated from each other and the projections.

2. The connector in accordance with claim 1 wherein the projections are configured to redirect the guide pin toward the central axis, the hole and the guide pin moving relative to one another.

3. The connector in accordance with claim 1 wherein the projections are configured to form an interference fit with the guide pin, the interference fit supporting a weight of the connector body in the mounted position.

4. The connector in accordance with claim 1 wherein the contacts are etched contacts, and the projections are etched projections.

5. The connector in accordance with claim 1 wherein the contacts and the projections comprise a common material.

6. The connector in accordance with claim 5 wherein the connector body comprises a cover layer, the cover layer including the first mating surface and extending along the side surface over a portion of the common material that forms the projections and the contacts.

7. The connector in accordance with claim 1 wherein the contacts and the projections have a substantially equal thickness.

8. The connector in accordance with claim 1 wherein the projections are coupled to the connector body along the first mating surface and the connector further comprises a surface mount projection coupled to the connector body along the second mating surface and extending toward the central axis, the projection coupled to the connector body along the second mating surface engaging the guide pin when the guide pin is inserted into the hole.

9. The connector in accordance with claim 1 wherein the connector body includes a cover layer, the conductive material layer being positioned between the cover layer and the substrate, the cover layer having openings proximate to the contacts and the projection so that the contacts and the projection are exposed to an exterior of the connector.

10. An electrical connector for electrically coupling an electronic module and an electrical component, the connector comprising:

a connector body having opposite first and second mating surfaces, the connector body including interconnects extending through the connector body between the first and second mating surfaces for electrically coupling the module and the component, the connector body having a hole extending therethrough along a central axis, the hole being configured to receive a guide pin from one of the module and the component;

a first surface mount projection coupled to the connector body along the first mating surface and extending toward the central axis; and a second surface mount projection coupled to the connector body along the second mounting surface and extending toward the central axis, the first and second projections engaging the guide pin when the guide pin advances through the hole along a misaligned path, the hole and the guide pin moving relative to one another, wherein the first projection is configured to resiliently flex against the guide pin and the second projection is configured to engage the guide pin and force the guide pin into alignment without flexing.

11. The connector in accordance with claim 10 wherein the first projection includes a plurality of first projections that engage and flex against the guide pin, the first projections forming an interference fit with the guide pin to hold the connector body in a mounted position.

12. The connector in accordance with claim 10 wherein the second projection comprises a ring having an inner edge that completely encircles the central axis, the inner edge engaging the guide pin when the guide pin is moved along the misaligned path.

13. The connector in accordance with claim 10 wherein the interconnects comprise etched contacts positioned along the first mating surface, the first projection being an etched first projection.

14. The connector in accordance with claim 10 wherein the interconnects comprise contacts positioned along the first mating surface, the contacts and the first projection comprising a common material.

15. The connector in accordance with claim 14 wherein the connector body comprises a substrate having a side surface and a cover layer, the contacts and the projections positioned on the side surface of the substrate, the cover layer including the first mating surface and extending along the side surface over a portion of the common material that forms the projections and the contacts.

16. The connector in accordance with claim 10 wherein the second projection comprises an inner edge that is sized and shaped relative to the guide pin such that the guide pin clears the inner edge without engaging the inner edge when the guide pin is moved along an aligned path.

17. An electrical connector assembly for electrically coupling an electronic module and an electrical component, the connector assembly comprising:

one of the electronic module or the electrical component having a mating face and including a guide pin that projects from the mating face;

an electrical connector comprising:

a connector body having opposite first and second mating surfaces, the connector body including interconnects extending through the connector body between the first and second mating surfaces for electrically coupling the module and the component, the connector body having a hole extending therethrough along a central axis, the hole being configured to receive the guide pin;

first surface mount projections coupled to the connector body along the first mating surface and extending into the hole; and a second surface mount projection coupled to the connector body along the second mounting surface and extending into the hole, the first and second projections engaging the guide pin when the guide pin advances through the hole along a misaligned path, the first projection engaging the guide pin before the second projection.

18. The connector assembly in accordance with claim 17 wherein the interconnects include contacts located along the first mating surface and wherein the connector body comprises a substrate having a conductive material layer deposited thereon, the conductive material layer having the contacts and the first projections formed therein, the contacts being isolated from each other and the first projections along the first mating surface of the connector body.

19. The connector assembly in accordance with claim 17 wherein the first projections are configured to resiliently flex against the guide pin and the second projection is configured to engage the guide pin and force the guide pin into alignment without flexing.

* * * * *